US005547393A

United States Patent [19]

Jansen

[11] Patent Number: 5,547,393

[45] Date of Patent: Aug. 20, 1996

[54] BEAUTY SALON APPLIANCE WORKSTATION

[75] Inventor: Janice Jansen, Pocahontas, Ark.

[73] Assignee: Charles Allen, Jonesboro, Ark.

[21] Appl. No.: 389,776

[22] Filed: Feb. 16, 1995

[51] Int. Cl.[6] ..... A45D 4/16

[52] U.S. Cl. ..... 439/501; 132/233; 219/242

[58] Field of Search ..... 439/501, 4; 242/378.4, 242/380, 385.1; 219/242, 541, 222, 225; 132/229, 314, 233

[56] References Cited

U.S. PATENT DOCUMENTS

| | | | |
|---|---|---|---|
| D. 287,916 | 1/1987 | DelGarbino | D6/567 |
| D. 347,538 | 6/1974 | Fleischer | D6/567 |
| 4,114,273 | 9/1978 | McGaha | 32/22 |
| 4,159,773 | 7/1979 | Losenno | 211/60 T |
| 4,378,473 | 3/1983 | Noorigian | 191/12.2 R |
| 4,483,330 | 11/1984 | Jacobsen et al. | 242/378.4 |
| 5,014,371 | 5/1991 | Heel | 4/516 |
| 5,124,532 | 6/1992 | Hafey et al. | 219/242 |
| 5,220,931 | 6/1993 | Aida | 219/222 |

*Primary Examiner*—Gary F. Paumen
*Attorney, Agent, or Firm*—Ray F. Cox, Jr.

[57] ABSTRACT

A beauty salon appliance workstation for organizing beauty salon appliances such as blow dryers, curling irons and the like. A cabinet is provided with receptacles for storing a number of appliances and each appliance is associated with a separate retractable extension cord. Further, each appliance is provided with a short "pigtail" type power cord so that when connected to a retractable extension cord no dangling loop is power cord is formed when the appliances are stored in the receptacles.

2 Claims, 2 Drawing Sheets

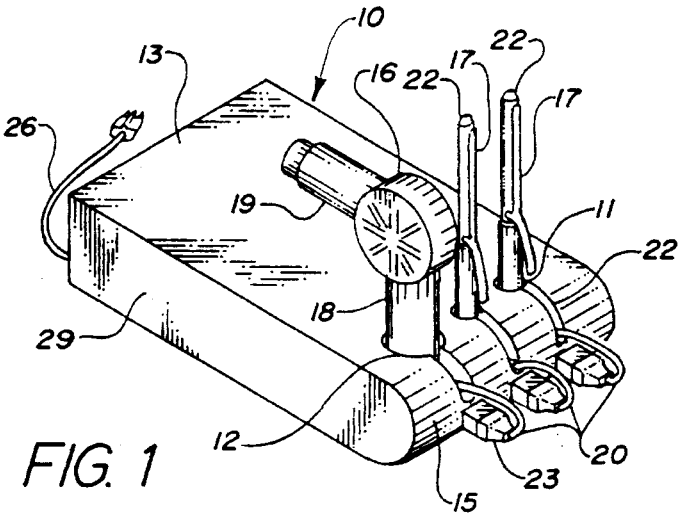
FIG. 1
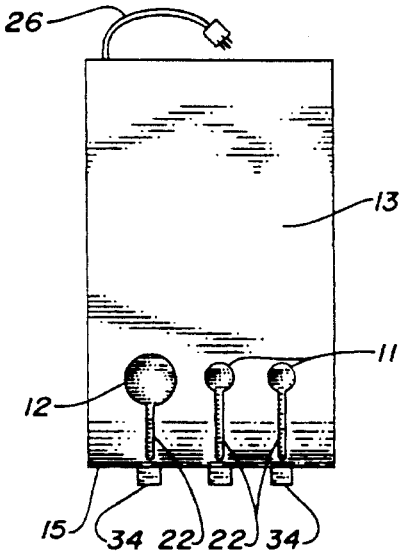
FIG. 2
FIG. 3
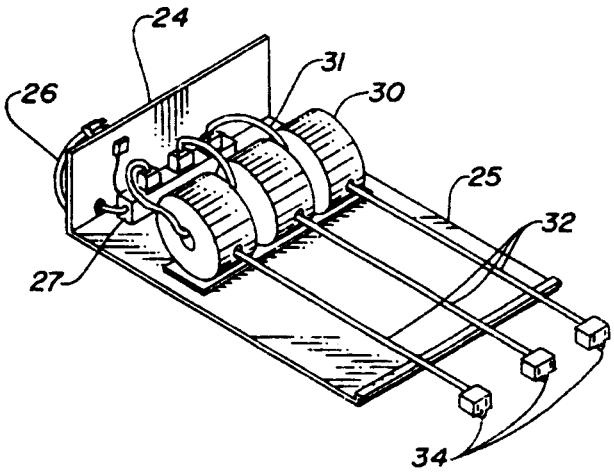
FIG. 4
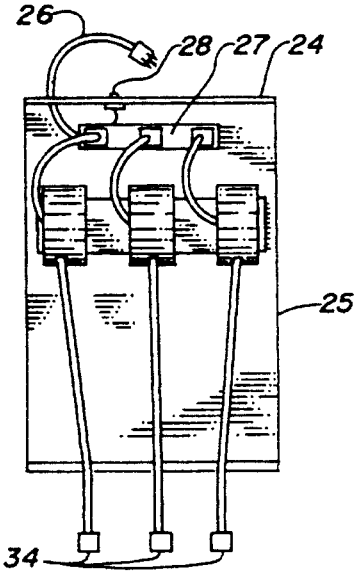

FIG. 5
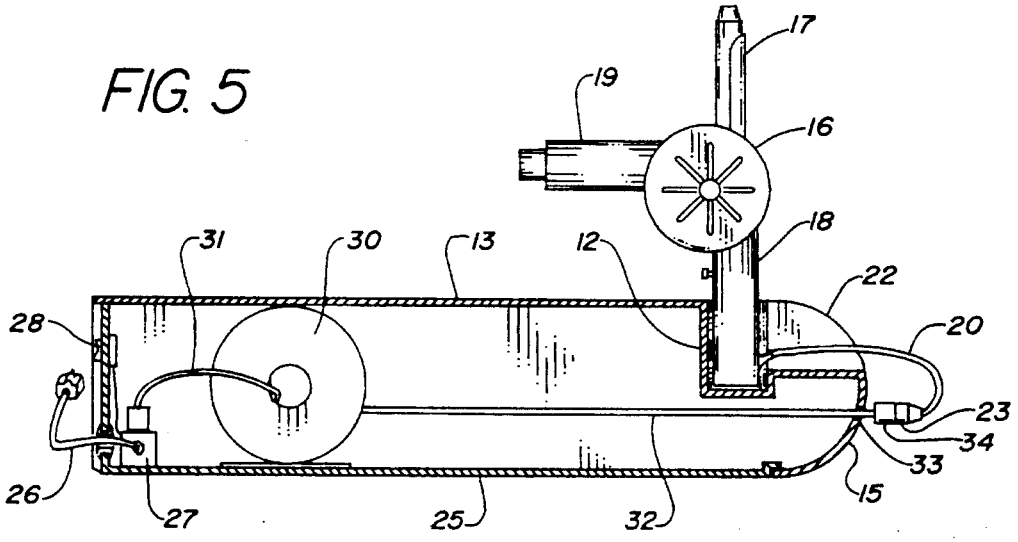
FIG. 7
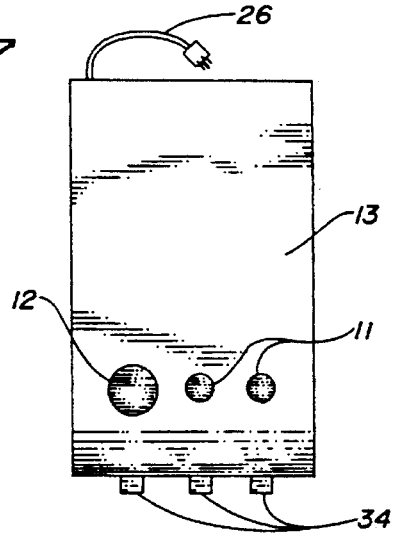
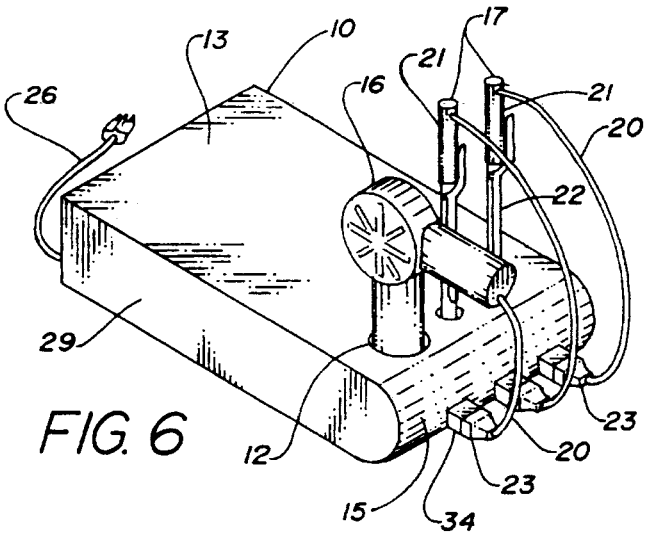
FIG. 6
FIG. 8
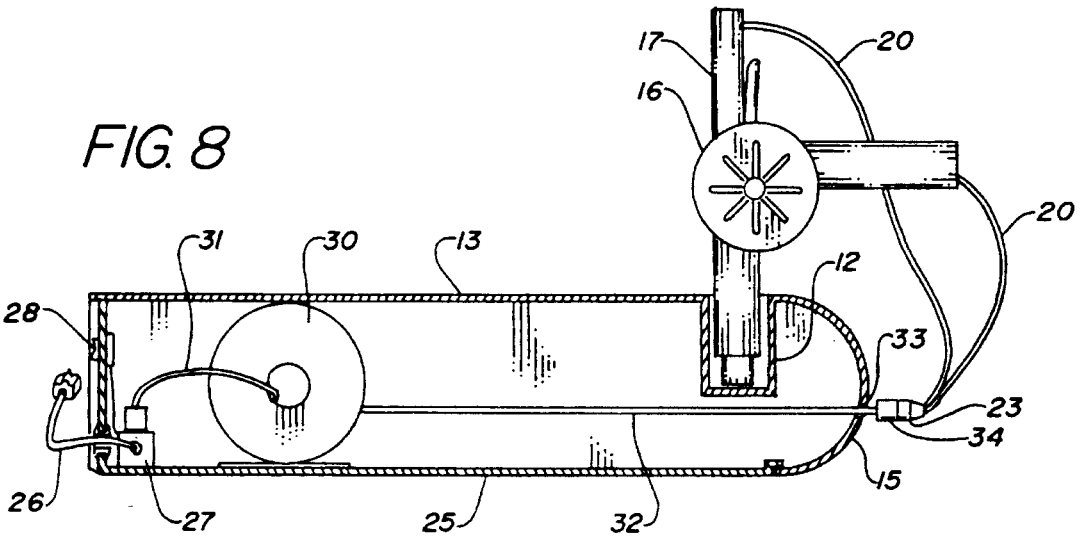

BEAUTY SALON APPLIANCE WORKSTATION

BACKGROUND OF THE INVENTION

The field of the invention relates to beauty salon appliances and more particularly to a workstation including receptacles for storing beauty salon appliances safely and accessibly when not in use, and further having shortened power cords in conjunction with retractable extension cords to prevent the safety hazard of dangling electrical cords.

The operation of beauty salons typically requires the use of a significant number of hand held electrical appliances. Among other appliances, blow dryers and curling irons are commonly employed. When not actually in use, it is desirable that these appliances be kept safely stored in such a way that they are easily accessible and yet do not cause a safety hazard, as for example by exposing a heating element.

Various devices to organize and store beauty salon appliances are known in the art. For example, U.S. Pat. No. 5,124,523 discloses an organizer for cordless hair salon utensils. The organizer includes a housing with a series of receptacles for hair salon utensils such as hair dryers and curling irons. Each of the receptacles is provided with a recharging plug. This patent, however, does not disclose any provision for extension cords since it discloses an organizer for rechargeable cordless appliances.

U.S. Pat. No. 4,159,773 discloses a tool hanger for supporting curling irons and blow dryers. U.S. Design Pat. Nos. 287,916 and 347,538 disclose brackets or holders for beauty salon utensils including curling irons and hair dryers.

U.S. Pat. No. 5,014,371 discloses a portable salon unit including a movable cart with electrical supply.

None of these patents are directed to the problem of storing beauty shop appliances in such a way that dangling electrical cords are kept out of the way of the user. A similar problem in a different field of technology is addressed in U.S. Pat. No. 4,114,273 issued to McGaha on Sep. 19, 1978 for "Hand Piece Instrument Console Apparatus having Improved Mechanisms for Extending and Retracting Operating Flexible Hose." McGaha discloses an apparatus for holding dental or medical instruments. The invention includes a cabinet containing a number of mechanisms for retracting and extending the cords attached to the dental or medical instruments. In addition, this device provides a number of receptacles for holding the instruments when they are not in use. This apparatus is not specifically adapted to beauty salon appliances.

It is therefore an object of the present invention to provide for a beauty salon appliance workstation which is adapted to safely and accessibly store beauty salon utensils when not in use. It is a further object of the present invention to provide means to prevent the problem of dangling electrical cords which present a safety hazard and an inefficient working environment.

SUMMARY OF THE INVENTION

To overcome the disadvantages and problems of the prior art, the present invention provides for a beauty salon appliance workstation for organizing beauty salon appliances such as hair dryers and curling irons. The workstation comprises a cabinet containing a number of holders or receptacles, each of which are sized to receive a blow dryer or a curling iron or similar beauty shop appliance. The cabinet is further provided with a number of retractable extension cords, one extension cord for each appliance. The extension cords are provided with a single female outlet as opposed to the typical retractable extension cords which have multiple outlets. The beauty shop appliances are provided with a short "pigtail" type of male electrical plug in place of the typical long power cord provided with beauty shop appliances. The extension cords are retractable using a reel type ratchet and pawl mechanism or the like of the kind which is commonly employed in retractable extension cords and drop lights. Therefore, when the beauty salon appliance is placed in its receptacle and the extension cord is completely retracted, only a short length of electrical power cord remains outside the cabinet. There is, therefore, no dangling loop of electrical cord formed to produce a safety hazard.

BRIEF DESCRIPTION OF THE DRAWINGS

Other objects and advantages of the present invention will become apparent from a consideration of the detailed description of the preferred embodiments in conjunction with the annexed drawings in which:

FIG. 1 is a perspective view of one embodiment of the present invention in which the beauty salon appliance receptacles are provided with a slot to accommodate the power cord when the appliances are oriented with the power cord connection down.

FIG. 2 is a top plan view of the invention embodied in FIG. 1 with the appliances removed for clarity.

FIG. 3 is a perspective view of the interior of the cabinet with the appliances and the top of the cabinet removed.

FIG. 4 is a top plan view of the interior of the cabinet with the cabinet top and appliances removed.

FIG. 5 is a sectional side elevation of the embodiment of the invention shown in FIGS. 1 and 2.

FIG. 6 is a perspective view of an alternative embodiment of the invention without the power cord slot.

FIG. 7 is a top plan view of the embodiment of the invention shown in FIG. 6 with the appliances removed for clarity.

FIG. 8 is a sectional side elevation of the embodiment of the present invention shown in FIGS. 6 and 7.

DETAILED DESCRIPTION OF THE PREFERRED EMBODIMENTS

The overall appearance of the present invention may be described with reference to FIGS. 1 and 6. A cabinet 10 contains a plurality of receptacles 11, 12 which are disposed upon the top surface 13 of the cabinet 10.

While the general size and shape of the cabinet 10 are not critical to the functioning of the present invention, the cabinet 10 is most desirably sized so that its front-to back dimension fits comfortably on a typical vanity, storage cabinet or similar work surface. Likewise, it is desirable that the front of the cabinet 10 be rounded to minimize the hazards associated with sharp corners. Finally, it is also desirable that the top surface 13 of the cabinet 10 be horizontal to allow its use for additional storage space.

The receptacles 11, 12 are essentially vertical cylindrical bores in the top 13 of the cabinet 10. The receptacles 11, 12 are located near the front 15 of the cabinet 10 for convenience.

The receptacles 11, 12 are sized to receive beauty salon appliances such as blow dryers and curling irons. As illustrated in FIGS. 2 and 7, a larger receptacle 12 is shown sized to hold a blow dryer while a smaller receptacle 11 is sized as shown to hold a curling iron. Typically the receptacle 12 for a blow dryer will be approximately 2½ inches in diameter while the receptacle 11 for the curling iron would be approximately 1½ inches in diameter. Different sizes and types of beauty salon utensils may be accommodated within the scope of the present invention.

Beauty salon utensils may be stored in either of two orientations. The two orientations may be described with respect to a blow dryer 16 as shown in FIGS. 1 and 5. The blow dryer 16 has a handgrip 18 and an outlet nozzle 19. Typically the power cord 20 will be attached to the blow dryer 16 near the extremity of the hand grip 18. The heated portion of the appliance is the nozzle end 19. Likewise, with a curling iron 17 the power cord 20 is attached to the handgrip 21 at the opposite end of the appliance from the heated end 22. With regard to the curling iron 17, this may be seen more clearly with reference to FIGS. 1 and 6.

The two preferred embodiments of the present invention derive from the orientation selected for storing the appliances. The heated ends of the appliances 19, 22 may be stored downward in the receptacles 11, 12 as shown in FIGS. 6 and 8. In this orientation a slightly greater length of power cord 20 is exposed but the hazard of exposure to the heated ends of the appliances is diminished. If this orientation is selected, the receptacles 11, 12 should be made of heat resistant materials. In the opposite orientation as exemplified by FIGS. 1 and 5, it is not necessary that the receptacles 11, 12 be heat resistant.

The primary difference between the two preferred embodiments of the present invention is shown with reference to FIGS. 1, 2 and 5. If the appliances are stored with the handgrips 18, 21 in the downward position in the receptacles 11, 12, a slot 22 must be provided from each receptacle 11, 12 toward the front 15 of the cabinet 10 so as to accommodate the power cord 20.

Beauty salon appliances are typically provided with a power cord that is approximately 2 to 3 feet long. When stored or temporarily disposed on a work surface, these long power cords produce dangling loops which are both a safety hazard and inconvenient to the users. In the present invention, the appliances 16, 17 are provided with short "pigtail" type power cords 20. The pigtail power cords should be as short as practicable, typically approximately 6 inches long. The pigtail power cords terminate in a male type electrical plug 23. The supply of electrical power to the appliances 16, 17 may be described with reference to FIGS. 3 and 4. FIGS. 3 and 4 illustrate the interior of the cabinet 10 with the top 13 and front 15 removed. In the preferred embodiment, the top 13 and front 15 comprise a single piece. However, other configurations are possible without departing from the spirit of the invention.

With the top 13 and front 15 removed, the cabinet 10 may be seen to comprise a back 24 and bottom 25. A power supply cord 26 exits from the back 24 and may be plugged into a standard wall outlet to obtain electrical power for the invention. The power supply cord 26 is electrically connected to an outlet strip 27 located within the cabinet 10 and affixed to the bottom 25. The outlet strip 27 is provided with a power switch 28 disposed on the back 24. While the power supply cord 26 and the power switch 28 are disposed on the back in the illustrated embodiments, certain circumstances may lead to a preferred orientation in which the power supply cord 26 and power switch 28 are disposed on a side 29 of the cabinet 10. This configuration might be most useful when the cabinet 10 must be placed close to a vertical wall.

A plurality of extension cord reels 30 are disposed within the cabinet 10 and rigidly affixed to the bottom 25. The extension cord reels 30 may embody any of a number of retractable extension cord technologies that are well known in the art. For example, commonly available drop lights, extension cords and the like use spring biased, ratchet and pawl type mechanisms to allow extension cords to be extracted and rewound. An example of such a retractable electrical cord is found in U.S. Pat. No. 4,378,473 issued to Noorigian on Mar. 29, 1983 for "Retractable Drop Light," the disclosure of which is hereby incorporated by reference.

The extension cord reels 30 are electrically connected to the outlet strip 26 by cords 31. Extension cords 32 are electrically energized through the cords 31 and may be extended from or retracted into the extension cord reels 30. As may be seen with reference to FIGS. 5 and 8, the extension cords 32 pass through openings 33 in the front 15 of the cabinet 10.

The extension cords 32 are provided with single female outlets 34. It is a significant feature of the present invention that the extension cords 32 are provided only with single female outlets. Typical extension cords are provided with multiple outlets. If multiple outlets were used in the present invention, multiple appliances could be plugged into each extension cord 32. In such a situation, a primary objective of the present invention would be defeated since it is important that only a single appliance 16, 17 be plugged into each extension cord 32. This is assured by having only single female outlets 34 on the end of each extension cord 32. Therefore, only a single appliance can be plugged into each extension cord thereby producing only a single electrical cord loop associated with each appliance. In this way multiple dangling loops of electrical cord are eliminated.

Each electrical plug 20 of each appliance 16, 17 is plugged into a respective female outlet plug 34. In practice it may be desirable to firmly connect each electric plug 20 to each outlet 34 using mechanical connectors of the type well known in the art.

It may be seen, therefore, particularly with reference to FIGS. 5 and 8 that the use of a shortened pigtail type power cord 20 in conjunction with a retractable extension cord 32 having only single female outlets 34 prevents the formation of hazardous dangling electrical cords as found in the prior art.

While the present invention is described with respect to preferred embodiments that describe a situation in which a single blow dryer 16 and two curling irons 17 are accommodated by the invention, other configurations are considered to be included within the scope of the present invention. For example, an arrangement of one blow dryer and four curling irons would be common. In addition, other types of appliances can be accommodated using the same techniques. It is therefore to be understood that while the present invention has been described with respect to certain preferred and alternative embodiments, such descriptions are intended to be exemplary only and not limiting to the full scope of the invention as set forth in the appended claims.

What is claimed is:

1. A beauty salon appliance workstation, comprising:

a plurality of beauty salon appliances;

a cabinet having a plurality of receptacles, each of said receptacles adapted to receive one of said plurality of beauty salon appliances;

a plurality of retractable extension cords disposed within said cabinet, each of said retractable extension cords having a single female electrical outlet;

means allowing said retractable extension cords to be extended outside said cabinet;

means preventing said electrical outlets from being retracted inside said cabinet;

means supplying electrical power to said retractable extension cords; and said plurality of beauty salon appliances having "pigtail" type power cords with single male electrical plugs whereby each of said male electrical plugs is connected to a respective one of said female electrical outlets such that, when said retractable extension cord is retracted, no substantial dangling loop of said power cords exists.

2. The beauty salon appliance workstation of claim 1 wherein each of said receptacles further comprise a slot portion to receive said "pigtail" type power cord.

* * * * *